US010873797B2

(12) United States Patent
Winton et al.

(10) Patent No.: US 10,873,797 B2
(45) Date of Patent: Dec. 22, 2020

(54) ROTATING LOUDSPEAKER

(71) Applicant: Harman International Industries, Incorporated, Stamford, CT (US)

(72) Inventors: Riley Winton, Canton, MI (US); David Mossington, Novi, MI (US); Chris Ludwig, Birmingham, MI (US); Christopher Michael Trestain, Livonia, MI (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 16/234,421

(22) Filed: Dec. 27, 2018

(65) Prior Publication Data

US 2019/0208298 A1 Jul. 4, 2019

Related U.S. Application Data

(60) Provisional application No. 62/612,042, filed on Dec. 29, 2017.

(51) Int. Cl.

| | |
|---|---|
| ***H04R 1/02*** | (2006.01) |
| ***H04R 3/12*** | (2006.01) |
| ***H04R 1/32*** | (2006.01) |

(52) U.S. Cl.

CPC ..... *H04R 1/026* (2013.01); *H04R 3/12* (2013.01); *H04R 1/32* (2013.01);

(Continued)

(58) Field of Classification Search

CPC .... H04R 1/026; H04R 3/12; H04R 2201/403; H04R 1/32; H04R 2205/024; H04R 2201/025

See application file for complete search history.

(56) References Cited

U.S. PATENT DOCUMENTS 4,757,544 A * 7/1988 Guy ..... H04R 1/026 381/304
4,953,223 A * 8/1990 Householder ..... F16M 11/24 381/182

(Continued)

FOREIGN PATENT DOCUMENTS

EP 2661101 A1 11/2013
JP 11117241 * 4/1999 ..... G09F 7/18

OTHER PUBLICATIONS

European Search Report for Application No. EP 1800101.9, dated May 23, 2019 (9 pages).

*Primary Examiner* — Oyesola C Ojo
(74) *Attorney, Agent, or Firm* — McCoy Russell LLP

(57) ABSTRACT

The present disclosure relates to loudspeaker devices and configurations. In one embodiment, a loudspeaker includes a housing structure having multiple faces. A first face and second face of the housing are between first and second ends to arrange speaker configurations. The housing structure is configured to rotate to direct at least one of the first speaker configuration and the second speaker configuration for output of audio. In one embodiment, the housing structure is an elongated triangular structure. Loudspeaker configurations can include one or more elements to rotate the housing structure to direct at least one of the first speaker configuration and the second speaker configuration for output of audio. Loudspeaker configurations may also include a controller to operate at least one of the first speaker configuration and the second speaker configuration for output of audio based on position of the housing structure.

19 Claims, 9 Drawing Sheets

(52) U.S. Cl.
CPC .. *H04R 2201/025* (2013.01); *H04R 2201/403* (2013.01); *H04R 2205/024* (2013.01)

(56) References Cited

U.S. PATENT DOCUMENTS

| | | | | |
|---|---|---|---|---|
| 6,628,793 | B1 * | 9/2003 | Porzilli | H04R 1/403 181/144 |
| 7,441,630 | B1 * | 10/2008 | Herrington | H04R 1/026 181/148 |
| 8,948,437 | B2 * | 2/2015 | Paye | H04R 5/02 381/386 |
| 9,469,254 | B1 * | 10/2016 | White | H04R 1/026 |
| 10,110,989 | B2 * | 10/2018 | Alexander | H04R 1/24 |
| 10,471,903 | B1 * | 11/2019 | Jordan | H04R 1/403 |
| 2004/0101152 | A1 * | 5/2004 | Fingleton | H04R 1/323 381/336 |
| 2005/0045777 | A1 | 3/2005 | Lee | |
| 2005/0058314 | A1 * | 3/2005 | Lee | H04R 1/026 381/335 |
| 2005/0063559 | A1 * | 3/2005 | Lee | H04R 1/025 381/335 |
| 2006/0050907 | A1 * | 3/2006 | Levitsky | H04R 1/345 381/304 |
| 2007/0144826 | A1 * | 6/2007 | An | H04R 1/26 181/199 |
| 2008/0095395 | A1 * | 4/2008 | Pieklik | A61H 33/60 381/387 |
| 2009/0046881 | A1 * | 2/2009 | Hsu | H04R 1/025 381/332 |
| 2009/0103753 | A1 * | 4/2009 | Hsu | H04R 1/403 381/307 |
| 2010/0158299 | A1 * | 6/2010 | Liu | H04R 1/026 381/333 |
| 2014/0314265 | A1 * | 10/2014 | Freund | H04R 1/1075 381/374 |
| 2017/0214989 | A1 | 7/2017 | Harms | |
| 2017/0272849 | A1 * | 9/2017 | Porciatti | F16M 13/027 |
| 2017/0295426 | A1 * | 10/2017 | Park | H04R 1/403 |
| 2019/0149907 | A1 * | 5/2019 | Gro Ler | H04R 1/025 381/335 |

* cited by examiner

ROTATING LOUDSPEAKER

CROSS-REFERENCE TO RELATED APPLICATION

This application claims priority to U.S. Provisional Application No. 62/612,042 filed on Dec. 29, 2017 and titled ROTATING LOUDSPEAKER, the content of which is expressly incorporated by reference in its entirety.

FIELD

The present disclosure relates to audio output devices, and more particularly to loudspeaker, soundbars and methods of operation.

BACKGROUND

Loudspeakers are usually configured for operation in a fixed position with one speaker configuration. One type of loudspeaker is a soundbar that projects audio from a wide enclosure. Soundbars can enhance audio experience but often suffer from limited acoustic output. The limited acoustic output may be especially relevant during periods of maximum desired loudness. In addition, conventional loudspeaker soundbars can be limited in terms of design and flexibility due to the type of enclosure. Attempts to rectify these issues often stall based on the constraints of packaging and footprint size. There exists a desire for loudspeaker and soundbar configurations that allow for improved and selectable acoustic output.

SUMMARY

Disclosed and claimed herein are loudspeaker configurations and devices, and methods for operation. One embodiment is directed to a loudspeaker including a housing structure having a first face and a second face, the first face and second face of the housing are between a first and second end. The loudspeaker includes a first speaker configuration arranged on the first face, and a second speaker configuration arranged on the second face. The housing structure is configured to rotate to direct at least one of the first speaker configuration and the second speaker configuration for output of audio In one embodiment, the housing structure is an elongated housing assembly having at least one of a triangular, square, rectangular and multi-sided cross sectional profile.

In one embodiment, the first speaker configuration and the second speaker configuration each include a plurality of speakers, and wherein the first speaker configuration includes at least one of a different number of speakers, different speaker placement and different speaker type in comparison to the second speaker configuration.

In one embodiment, the housing structure rotates relative to the first and second ends.

In one embodiment, the housing structure rotates with the first and second ends.

In one embodiment, the housing structure is rotatably mounted to the first and second ends.

In one embodiment, the loudspeaker includes at least one bracket mounted to the first and second end.

In one embodiment, the bracket is an elongated bar extending along a portion of the housing structure.

In one embodiment, the bracket is mounted to at least one of outer surfaces of the first and second ends, support elements of the first and second ends and notched channels of the first and second ends.

In one embodiment, the loudspeaker includes a drive unit to rotate the housing structure.

One embodiment is directed to a loudspeaker including a housing structure having an elongated triangular structure, a first speaker configuration arranged on the first face of the housing structure, and a second speaker configuration on the second face of the housing structure. The loudspeaker includes at least one element configured to rotate the housing structure to direct at least one of the first speaker configuration and the second speaker configuration for output of audio, and a controller to operate at least one of the first speaker configuration and the second speaker configuration for output of audio based on position of the housing structure.

In one embodiment, the first speaker configuration and the second speaker configuration each include a plurality of speakers, and wherein the first speaker configuration includes at least one of a different number of speakers, different speaker placement and different speaker type in comparison to the second speaker configuration.

In one embodiment, the housing structure rotates relative to first and second end units.

In one embodiment, the housing structure rotates with first and second end units.

In one embodiment, the housing structure is rotatably mounted to the first and second ends.

In one embodiment, the loudspeaker includes at least one bracket mounted to a first and second end of the housing structure.

In one embodiment, the bracket is an elongated bar extending along a portion of the housing structure.

In one embodiment, the bracket is mounted to at least one of outer surfaces of the first and second ends, support elements of the first and second ends and notched channels of the first and second ends.

In one embodiment, the loudspeaker includes a drive unit to rotate the housing structure.

In one embodiment, the housing structure is configured to rotate along a central axis of the loudspeaker to position one of the first speaker configuration and the first speaker configuration in a forward facing direction.

Other aspects, features, and techniques will be apparent to one skilled in the relevant art in view of the following detailed description of the embodiments.

BRIEF DESCRIPTION OF THE DRAWINGS

The features, objects, and advantages of the present disclosure will become more apparent from the detailed description set forth below when taken in conjunction with the drawings in which like reference characters identify correspondingly throughout and wherein.

DETAILED DESCRIPTION OF THE EXEMPLARY EMBODIMENTS

Overview and Terminology

Figure 1A:
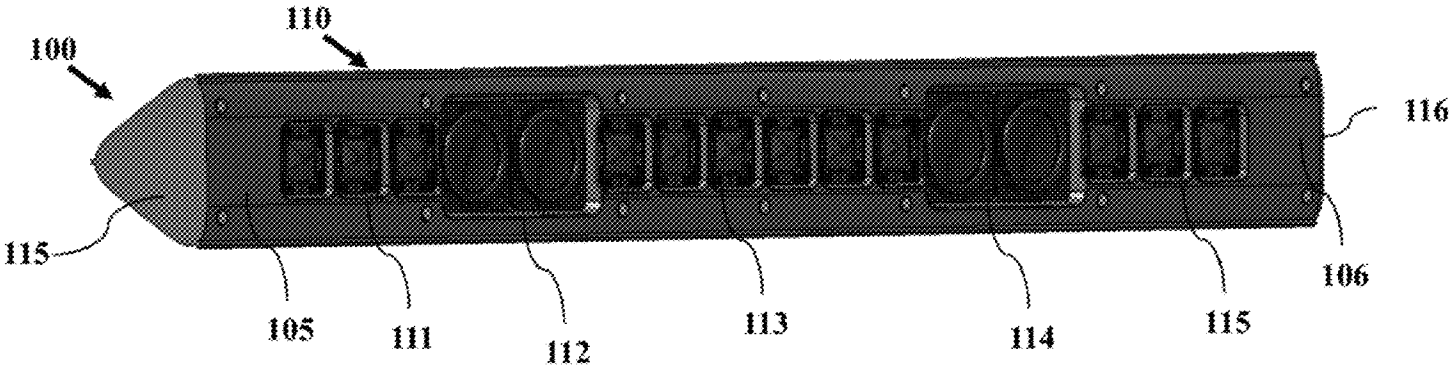
FIGS. 1A-1B depict a loudspeaker according to one or more embodiments.

One aspect of the disclosure is directed to a rotating loudspeaker assembly that can be rotated or moved to adjust the desired loudspeaker architecture based on which face of the loudspeaker is presented to the user. Embodiments are discussed herein for one or more loudspeaker architectures. By way of example, a triangular, rectangular, or other multi-sided shape may be employed for a housing structure. In one embodiment, one or more of faces of the housing structure can be loaded with different speaker configurations. In certain embodiments, the entire assembly can then rotate to present one face, and thus, a certain speaker configuration to the listener. According to one embodiment, different faces can be optimized for different acoustic technologies including but not limited to loudspeaker array processing similar to DIRAC Panorama, crosstalk cancellation, or phase-related signal processing, point-source architecture, or other technologies. Additionally, the prism faces that are pointed away from the primary listener can be optimized to enhance or isolate off-axis response and create acoustic isolation. Furthermore, the prism faces pointed away from the listener can be used for audio reproduction targeted to an additional non-primary listener group.

Embodiments of the disclosure allow for multiple types of acoustic optimization in an efficient packaging envelope familiarly known as a "soundbar." References to soundbars herein in may relate to a "sound bar," media bar, or other type of loudspeaker that projects audio from a wide enclosure.

Embodiments are directed to loudspeaker configurations and components. In one embodiment, a loudspeaker includes a housing structure, a first speaker configuration and a second speaker configuration. The housing may have one or more sides or faces between ends of the loudspeaker. In certain embodiments, a first speaker configuration is arranged on a first face and a second speaker configuration is arranged on a second face of the housing structure. The housing structure is configured to rotate to direct at least one of the first speaker configuration and the second speaker configuration for output of audio.

According to another embodiment, a loudspeaker includes a housing structure having an elongated triangular structure, a first speaker configuration arranged on the first face of the housing structure and a second speaker configuration on the second face of the housing structure. The loudspeaker may also include at least one element configured to rotate the housing structure to direct at least one of the first speaker configuration and the second speaker configuration for output of audio. The loudspeaker may also include a controller to operate at least one of the first speaker configuration and the second speaker configuration for output of audio based on position of the housing structure.

Although loudspeaker configurations are discussed herein with respect to soundbar applications, it should be appreciated that the loudspeaker and sound bar configurations discussed herein may be applied to other devices and for additional applications.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

Exemplary Embodiments

Figure 1B:
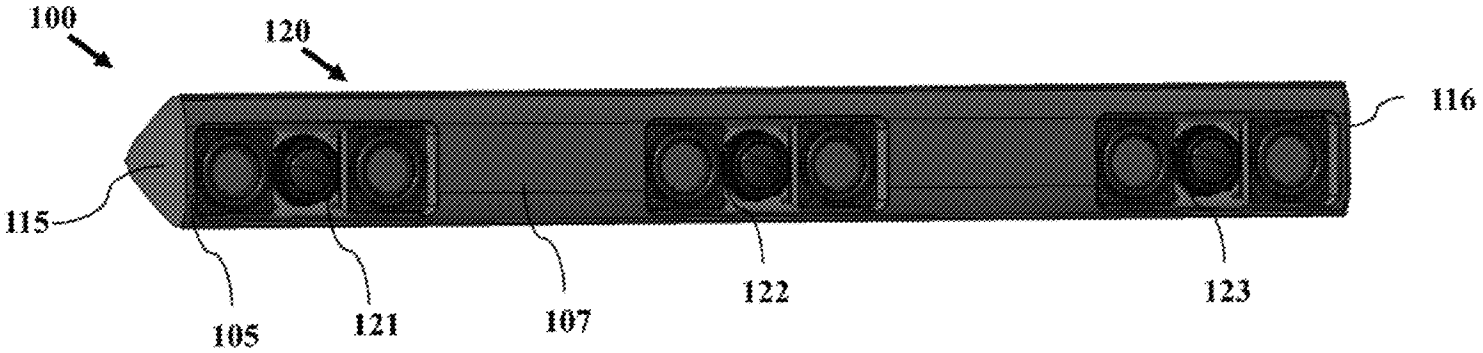

FIGS. 1A-1B depict a loudspeaker according to one or more embodiments. Referring first to FIG. 1A, loudspeaker 100 includes housing structure 105 having a plurality of faces. According to one embodiment, housing structure 105 also supports a plurality of speaker configurations for loudspeaker 100. Housing structure 105 may be an elongated housing assembly having at least one of a triangular, square, rectangular and multi-sided cross sectional profile.

FIG. 1A shows face 106 of housing structure 105 having speaker configuration 110. Speaker configuration 110 is mounted to housing structure 105 to output audio. According to one embodiment, housing structure 105 includes a first end 115 and a second end 116. Face 106 of housing structure 105 is located between first end 115 and a second end 116. FIG. 1B depicts face 107 of loudspeaker 100. Loudspeaker 100 allows for multiple soundbar speaker topologies in only one footprint. Compared to existing devices, loudspeaker 100 enhances performance, flexibility, and industrial design opportunities.

According to one embodiment, housing structure 105 is configured to rotate to direct at least one of the first speaker configuration 110 and a second speaker configuration (not shown in FIG. 1A) for output of audio. Rotation may include rotation of housing 105. In certain embodiments, rotation of loudspeaker 100 includes rotation of housing structure 105 with first end 115 and second end 116.

FIG. 1A depicts an exemplary arrangement for speaker configuration 110. As shown, speaker arrangement 110 includes five (5) speaker sections having twelve (12) speakers total. Speaker sections 111, 113 and 115 include three, six and three speakers, respectively, which may all includes speakers of the footprint. Speaker sections 112 and 114 include two speakers each, which may be larger than sections 111, 113 and 115. Speaker arrangement 110 may be configured to provide an acoustic output configuration. Speaker arrangement 110 may provide a first speaker topology.

FIG. 1B depicts face 107 of loudspeaker 100 and speaker configuration 120. Speaker arrangement 120 includes three (3) speaker sections having nine (9) speakers total. Speaker sections 121, 122 and 123 include three speakers each, which may all includes speakers of the footprint. Speaker sections 121, 122 and 123 each include two tweeter speakers and one low frequency speaker. As such, speaker arrangement 120 and speaker arrangement 110 may be configured to include at least one of a different number of speakers, different speaker placement and different speaker type in comparison to each other. Speaker arrangement 120 may be configured to provide an acoustic output configuration different from speaker configuration 110. Speaker arrangement 120 may provide a second speaker topology for loudspeaker 100.

As will be discussed herein below, loudspeaker 100 may be rotated. In addition, loudspeaker its elements may be controlled based on the position of arrangement of the loudspeaker.

Figure 2:
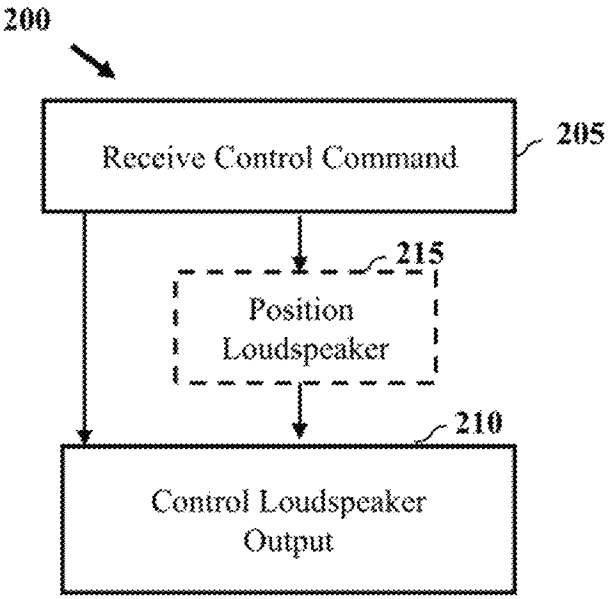
FIG. 2 depicts a process for operation of a loudspeaker according to one or more embodiments.

FIG. 2 depicts a process for operation of a loudspeaker according to one or more embodiments. Process 200 may be initiated by receiving a control command at block 205. Control commands may be received by a controller of the loudspeaker. In one embodiment, control commands at block 205 may be a power on command or output command to direct a loudspeaker (e.g., loudspeaker 100) to output audio. Accordingly, a controller the loudspeaker may control output at block 210 in response to the control command. In certain embodiments, output at block 210 may be to output audio using only the speaker configuration of the front face of the loudspeaker. In other embodiments, speakers of one or more speaker configurations may be controlled. By way of example, the front facing speaker configuration may be controlled as the primary source of audio output while one or more back facing speakers may be controlled entirely or selectively to output audio. As such, faces of the loudspeaker that are pointed away from the primary listener can be optimized to enhance or isolate off-axis response and create acoustic isolation. Furthermore, the loudspeaker faces pointed away from the listener can be used for audio reproduction targeted to an additional non-primary listener group.

Process 200 may optionally position the loudspeaker that block 215. The loudspeaker may be controlled to change the face or position of the soundbar and thus, change a speaker configuration for audio output.

Figure 3:
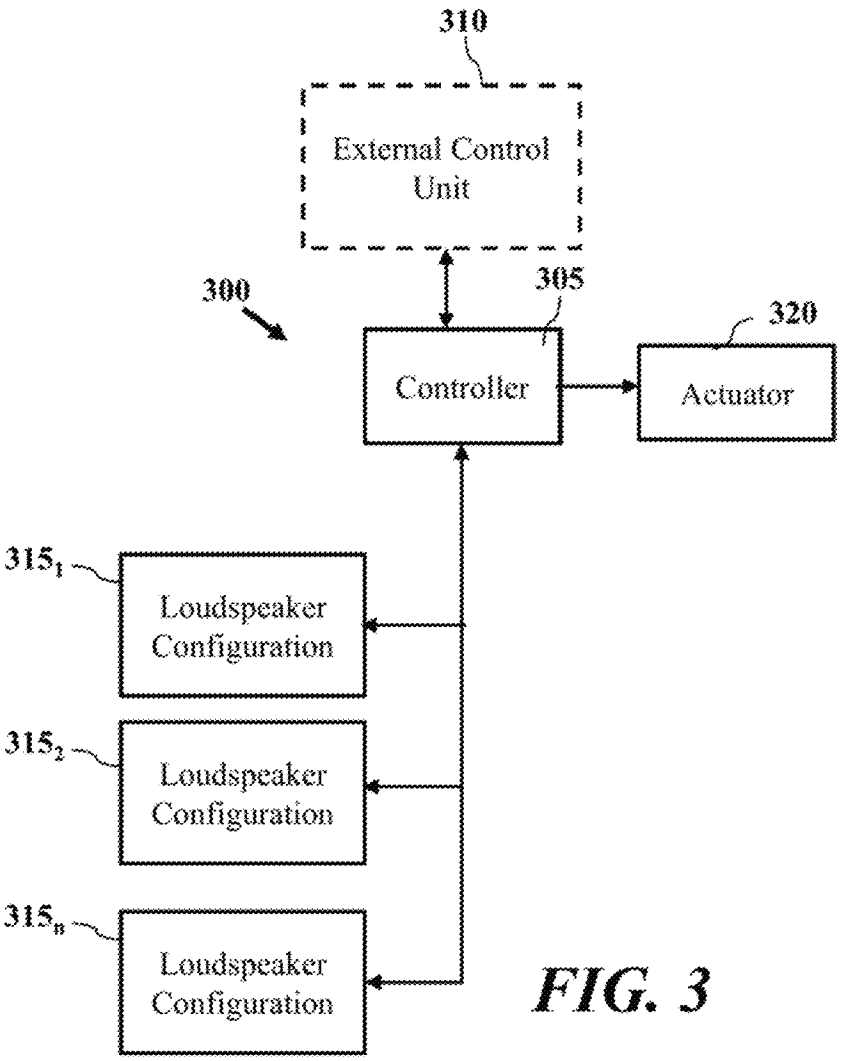
FIG. 3 depicts a graphical representation of a loudspeaker according to one or more embodiments.

FIG. 3 depicts a graphical representation of a loudspeaker according to one or more embodiments. Loudspeaker 300 is a simplified representation of loudspeaker elements, such as loudspeaker 100 and loudspeakers discussed herein. In one embodiment, loudspeaker 300 includes controller 305, a plurality of loudspeaker configurations $\mathbf{315}_{1-n}$, and an actuator 320 to position the loudspeaker faces. In certain embodiments, loudspeaker 300 may optionally receive control commands from an external control unit 310 by way of wired or wireless communication. Loudspeaker configurations $\mathbf{315}_{1-n}$ may each relate to a face of the loudspeaker.

Controller 305 may be a processor or controller including memory to store code for operation of loudspeaker 300 and to control activation of one or more of Loudspeaker configurations $\mathbf{315}_{1-n}$. Actuator 320 may relate to one or more of a mechanical, electrical and electro mechanical drive unit to rotation a loudspeaker. Loudspeaker 300 may also include one or more structural elements such as bearings and mounts that may interact with actuator 320.

Figure 4:
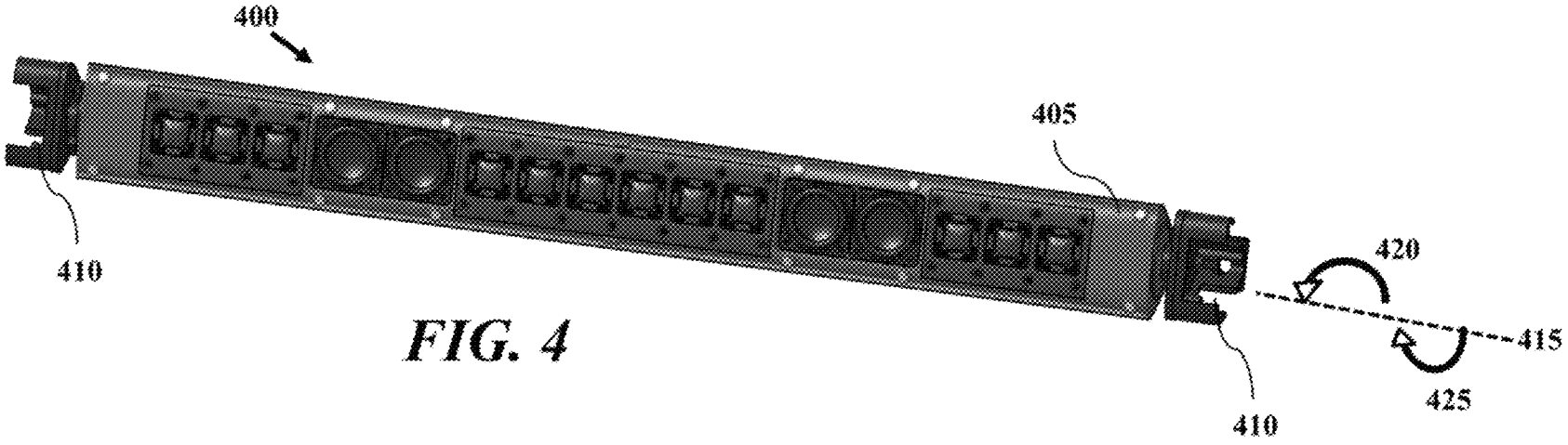
FIG. 4 depicts a graphical representation of a loudspeaker according to one or more embodiments.

FIG. 4 depicts a graphical representation of a loudspeaker according to one or more embodiments. Loudspeaker 400 is depicted including an elongated triangular housing 405 having a plurality of faces and speaker configurations. According to one embodiment housing structure 405 of loudspeaker 405 interfaces with two ends 410, such that housing structure 405 rotates relative to the ends 410. Rotation may be along an axis of loudspeaker 400 such as a central axis 415 and rotation may be in one or more directions, such as direction 420 (e.g., counter clockwise rotation) and direction 425 (e.g., clockwise rotation). Loudspeaker 400 may allow for complete rotations and/or partial rotation of housing structure 405. According to one embodiment, ends 410 may be static during rotation and mounted to one or more of a stand, bracket, mount, etc.

Figures 5A, 5B, 5C:
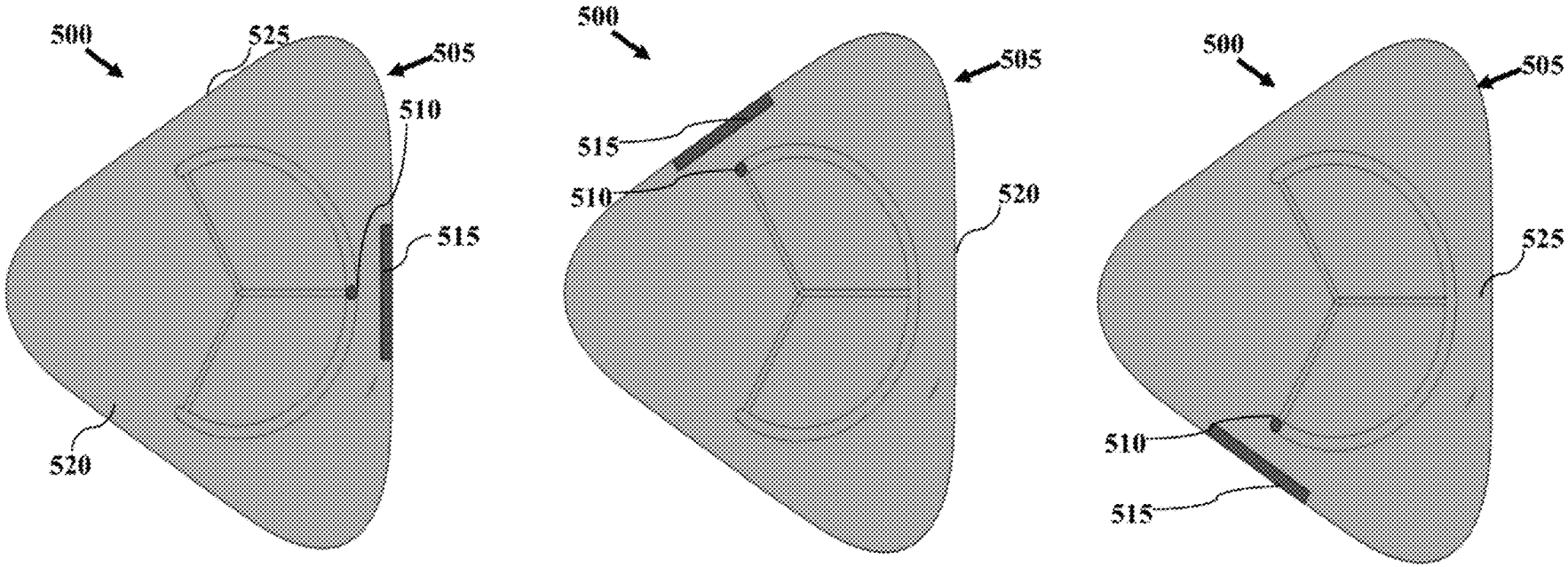
FIGS. 5A-5C depict graphical representations of loudspeaker positioning according to one or more embodiments.

FIGS. 5A-5C depict graphical representations of loudspeaker positioning according to one or more embodiments. According to one or more embodiments, loudspeakers may be rotated to one or more positions. FIGS. 5A-5C depict loudspeaker 500 including a triangular cross section. FIG. 5A depicts a neutral position according to one or more embodiments. In the neutral position, face 510 of loudspeaker 500 and speaker elements 515 are the forward facing elements 505 of loudspeaker 500. FIG. 5B depicts a position of loudspeaker rotated up (e.g., 120°) according to one or more embodiments. In the rotated up position, face 510 of loudspeaker 500 and speaker elements 515 are now backward and up facing elements of loudspeaker 500. Face 520 of loudspeaker 500 is now the forward facing element 505. FIG. 5C depicts a position of loudspeaker rotated down (e.g., 120°) according to one or more embodiments. In the rotated down position, face 510 of loudspeaker 500 and speaker elements 515 are backward and down facing elements of loudspeaker 500. Face 525 of loudspeaker 500 is now the forward facing element 505. In certain embodiment, resting rotation positions may be based on the number of sides of the loudspeaker housing.

Figure 6A:
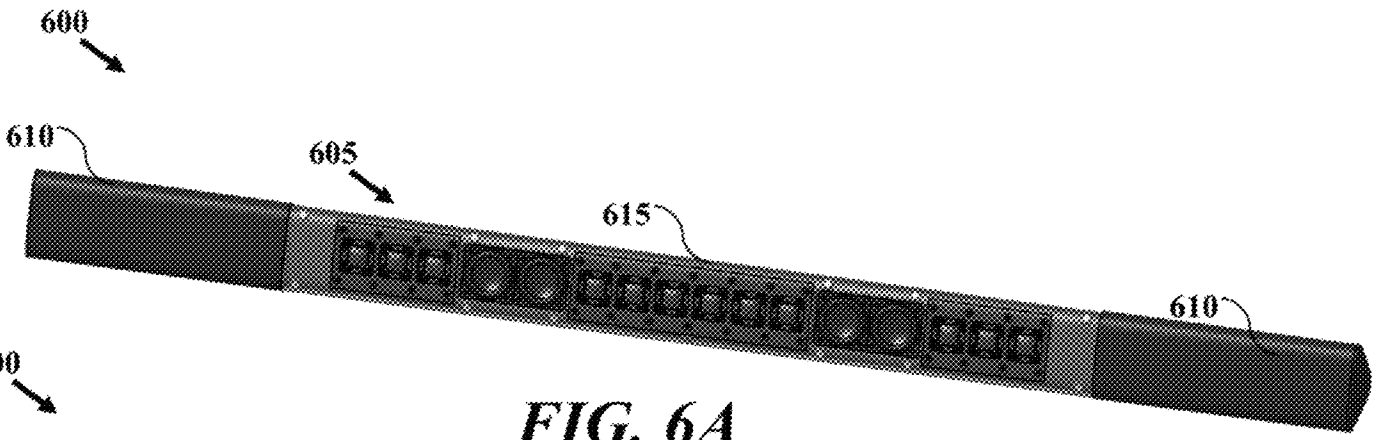
FIGS. 6A-6C depict graphical representations of loudspeaker positions according to one or more embodiments.
Figure 6B:
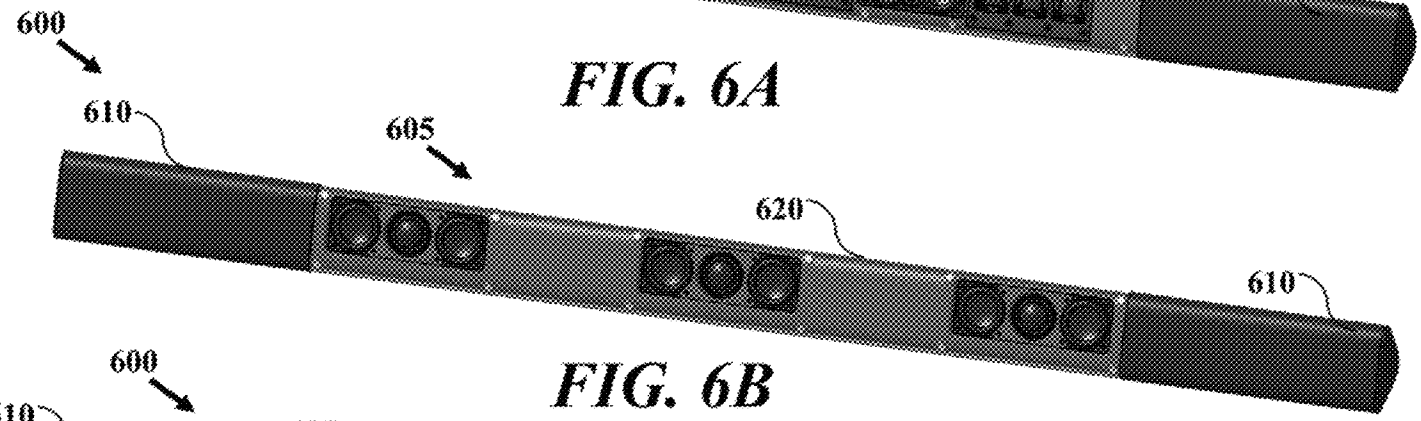
Figure 6C:
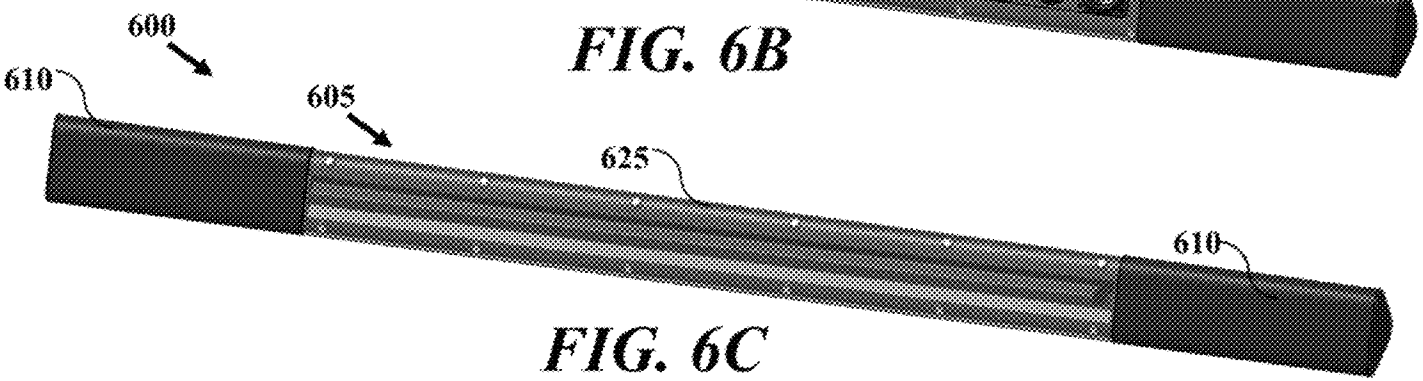

FIGS. 6A-6C depict graphical representations of loudspeaker positions according to one or more embodiments. FIGS. 6A-6B depict rotation of a loudspeaker the housing structure is rotatably mounted to the first and second ends. In FIG. 6A, loudspeaker 600 includes a face of housing structure 605 having speaker configuration 615 between ends 610. In FIG. 6B, loudspeaker 600 includes a face having speaker configuration 620 between ends 610. In FIG. 6C, loudspeaker 600 includes a face having a plate configuration 625 between ends 610.

According to one embodiment, loudspeaker 600 includes a rotatable center portion. The center portion of the housing structure 605 rotates while ends 610 are static. According to one embodiment, ends 610 may include a drive unit to rotate housing structure 605. One of ends 610 may include a motor and gearbox, while the other includes bearings and cabling according to one embodiment.

According to one embodiment, loudspeaker elements discussed herein may be mounted to at least one of outer surfaces of the first and second ends, support elements of the first and second ends and notched channels of the first and second ends.

Figure 7B:
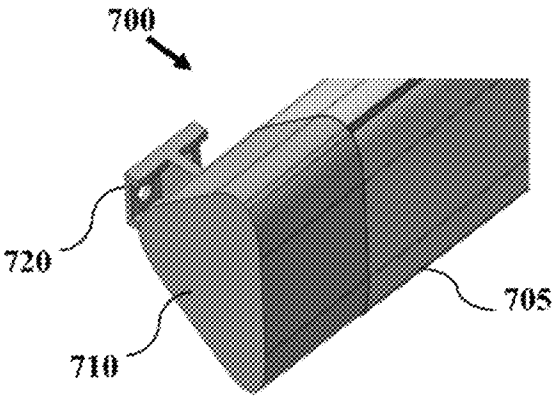
FIGS. 7A-7B depict graphical representations of a loudspeaker bracket according to one or more embodiments.
Figure 7A:
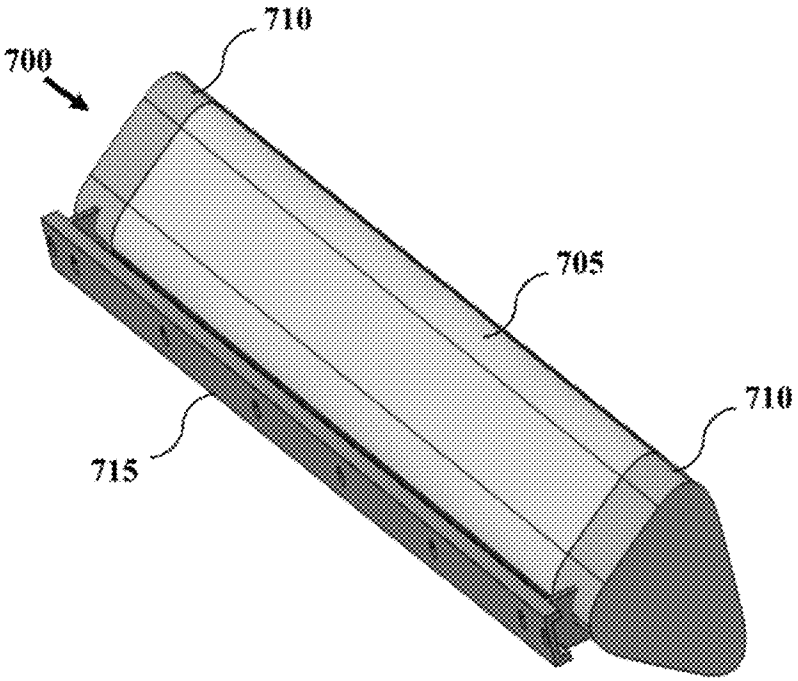

FIGS. 7A-7B depict graphical representations of a loudspeaker bracket according to one or more embodiments. In FIG. 7A, loudspeaker 700 includes housing structure 705, ends 710 and bracket 715. Instead of mounting each end of loudspeaker 700 separately, a single bracket, such as bracket 715 may joint to two static ends 710. As such, housing structure 705 rotates within the first and second ends 710. Bracket 715 is one bracket or an elongated bar extending along a portion of the housing structure mounted to the ends 710. In FIG. 7B, a portion of loudspeaker 700 is shown. According to one embodiment, each end shown by 710 may include a mounting structure 720 to be coupled to a bracket (e.g., bracket 715) or other surface.

Figure 8:
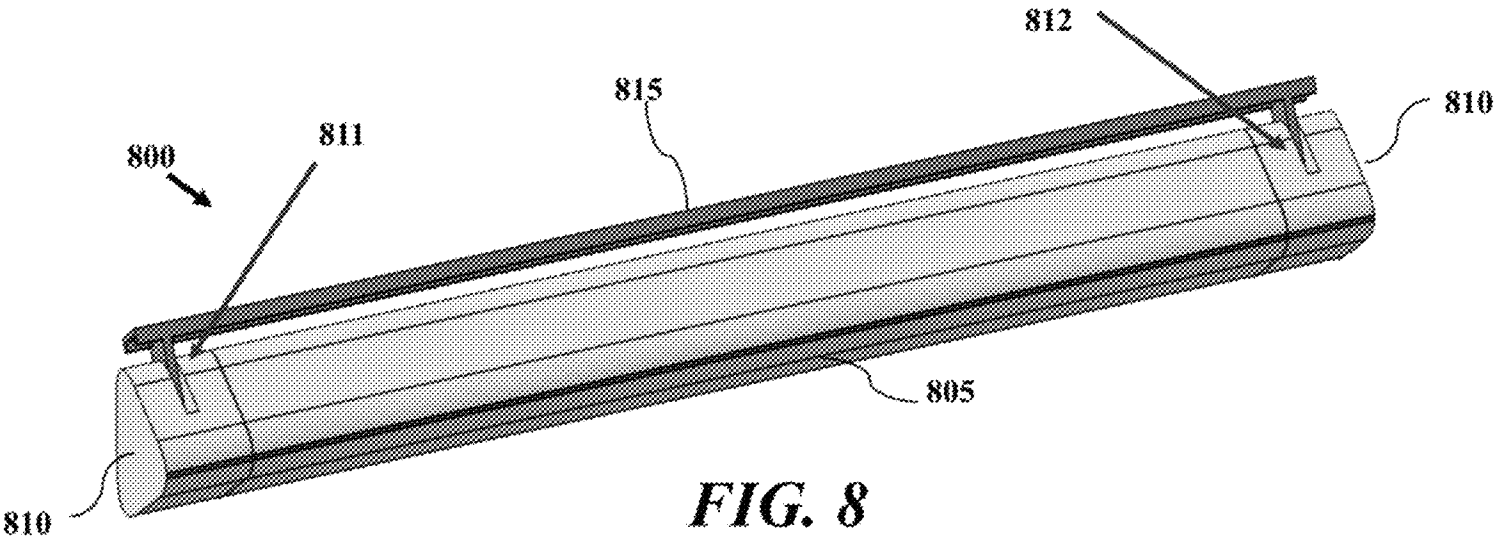
FIG. 8 depicts a graphical representation of a loudspeaker mounting configuration according to one or more embodiments.

FIG. 8 depicts a graphical representation of a loudspeaker mounting configuration according to one or more embodiments. Loudspeaker 800 is configured to rotate such that ends of the housing structure rotate with the rest of the sound bar. In FIG. 8, loudspeaker 800 includes housing structure 805, ends 810 and bracket 815. Ends 810 include cut outs 811 and 812 to receive bracket 815. As such, housing structure 805 rotates with the first and second ends 810.

Figure 9A:
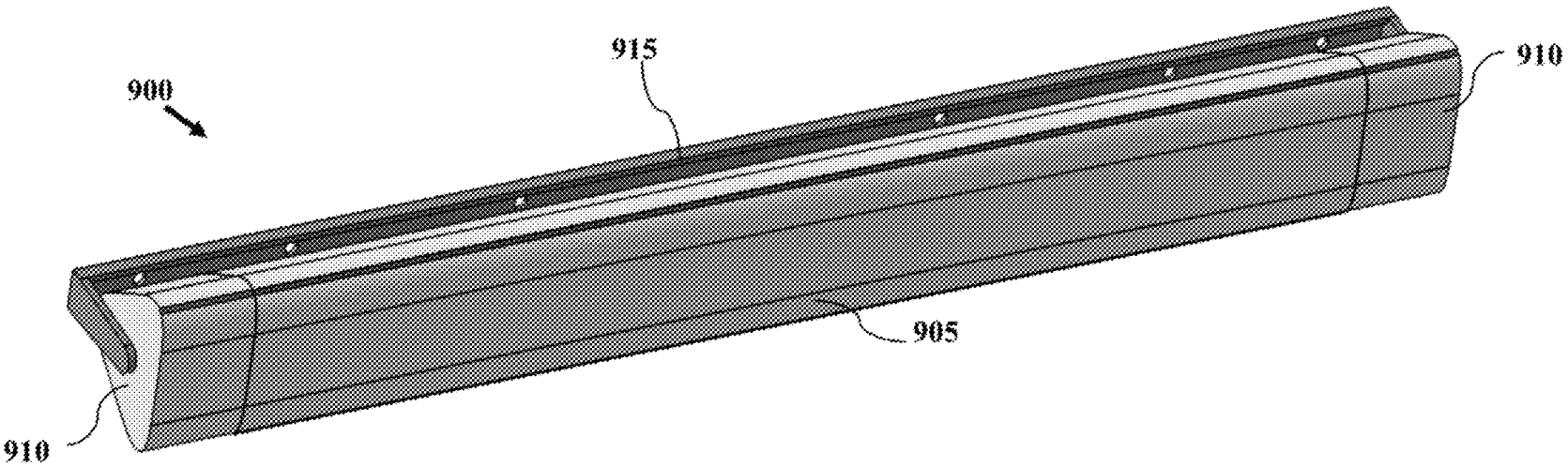
FIGS. 9A-9B depict graphical representations of a loudspeaker mounting configuration according to one or more embodiments.
Figure 9B:
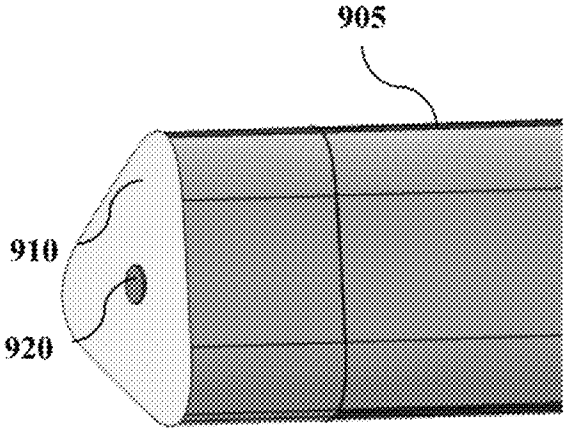

FIGS. 9A-9B depict graphical representations of a loudspeaker mounting configuration according to one or more embodiments. Loudspeaker 900 is configured for rotation relative to an axis of revolution at both ends of a bracket. In FIG. 9, loudspeaker 900 includes housing structure 905, ends 910 and bracket 915. According to one embodiment, bracket 915 is mounted to at least one of outer surfaces of the first and second ends 910. In FIG. 9B, a portion of loudspeaker 900 is shown. According to one embodiment, each end shown by 910 may include a mounting point 920 to be coupled to a bracket (e.g., bracket 915) or other structure.

Figure 10B:
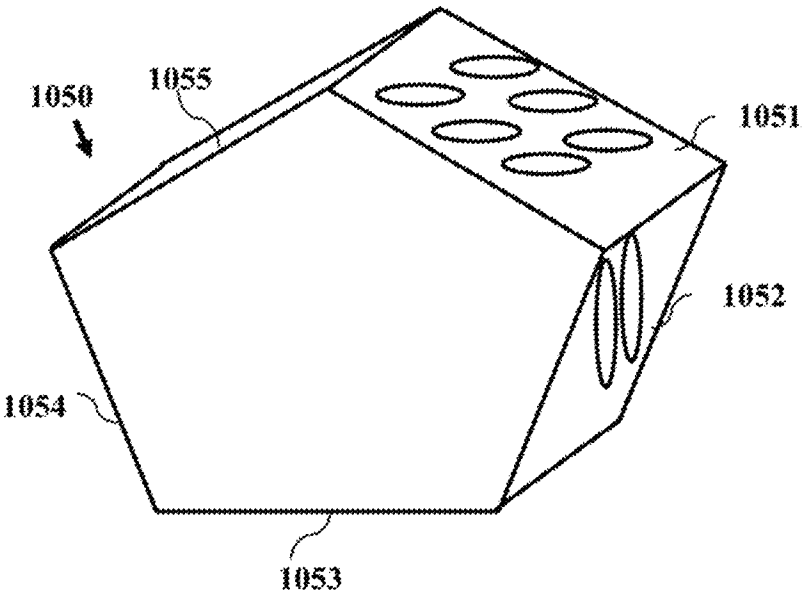
FIGS. 10A-10B depict graphical representations of a loudspeaker configuration according to one or more embodiments.
Figure 10A:
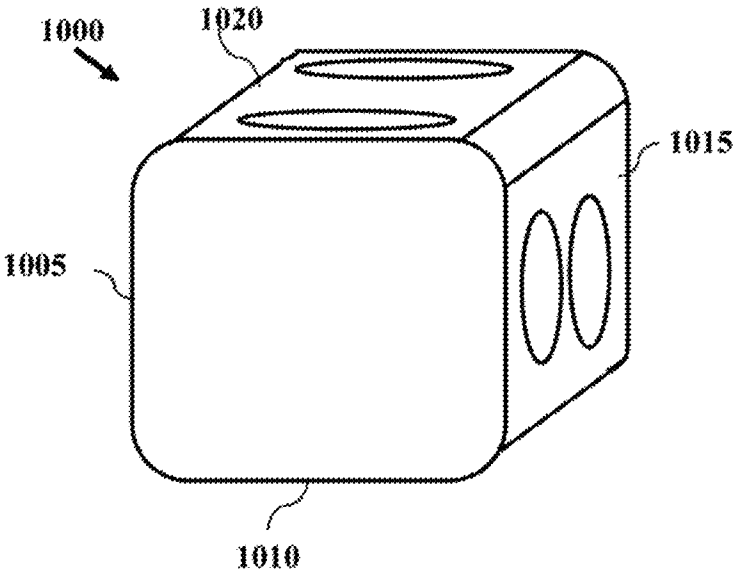

FIGS. 10A-10B depict graphical representations of a loudspeaker soundbar configuration according to one or more embodiments. According to one embodiment loudspeakers as discussed herein may be associated with one or more multi-sided housing configurations. FIG. 10A depicts a representation of a loudspeaker housing structure 1000 including a square cross sectional configuration having rounded edges. Housing structure 1000 includes sides 1005, 1010, 1015 and 1020 which may each include a different speaker configuration or arrangement. FIG. 10B depicts a representation of a loudspeaker housing structure 1050 including a five-sided cross sectional configuration having pointed edges. Housing structure 1050 includes sides 1051, 1052, 1053, 1054, and 1055 which may each include a different speaker configuration or arrangement.

While this disclosure has been particularly shown and described with references to exemplary embodiments thereof, it will be understood by those skilled in the art that various changes in form and details may be made therein without departing from the scope of the claimed embodiments.

What is claimed is:

1. A loudspeaker, comprising:

a housing structure having a first face and a second face, wherein the first face and second face of the housing are between a first and second end;

a first speaker configuration arranged on the first face; and a second speaker configuration arranged on the second face, a motor configured to rotate the housing structure, including rotating both the first speaker configuration and the second speaker configuration together, to direct at least one of the first speaker configuration and the second speaker configuration for output of audio, wherein the housing structure is configured to rotate to direct at least one of the first speaker configuration and the second speaker configuration for output of audio; and a controller to rotate the housing structure via the motor, and further configured to operate at least one of the first speaker configuration and the second speaker configuration for output of audio based on position of the housing structure, wherein when rotated in a first position with the first speaker configuration facing in a first direction, the controller is configured to select the first speaker configuration to be a primary source of audio output, and when rotated in a second position with the second speaker configuration facing the first direction, the controller is configured to select the second speaker configuration to be the primary source of audio output.

2. The loudspeaker of claim 1, wherein the housing structure is an elongated housing assembly having at least one of a triangular, square, rectangular and multi-sided cross sectional profile.

3. The loudspeaker of claim 1, wherein the first speaker configuration and the second speaker configuration each include a plurality of speakers, and wherein the first speaker configuration includes at least one of a different number of speakers, different speaker placement, and different speaker type in comparison to the second speaker configuration.

4. The loudspeaker of claim 1, wherein the housing structure rotates relative to the first and second ends, wherein the first face is angled with respect to the second face.

5. The loudspeaker of claim 1, wherein the housing structure rotates with the first and second ends.

6. The loudspeaker of claim 1, wherein the housing structure is rotatably mounted to the first and second ends.

7. The loudspeaker of claim 1, further comprising at least one bracket mounted to the first and second ends, wherein when in the first position, the controller controls output of the second speaker configuration to enhance or isolate off-axis response and create acoustic isolation.

8. The loudspeaker of claim 6, wherein the bracket is an elongated bar extending along a portion of the housing structure.

9. The loudspeaker of claim 6, wherein the bracket is mounted to at least one of outer surfaces of the first and second ends, support elements of the first and second ends and notched channels of the first and second ends.

10. The loudspeaker of claim 2, wherein when rotated in the first position, the first speaker configuration is the only speaker configuration generating audio output.

11. A loudspeaker, comprising:

a housing structure having an elongated triangular structure, the housing structure having a first face and a second face;

a first speaker configuration arranged on the first face of the housing structure;

a second speaker configuration on the second face of the housing structure;

at least one element configured to rotate the housing structure to direct at least one of the first speaker configuration and the second speaker configuration for output of audio; and a controller to operate at least one of the first speaker configuration and the second speaker configuration for output of audio based on position of the housing structure, wherein the first speaker configuration and the second speaker configuration each include a plurality of speakers, and wherein the first speaker configuration includes at least one of a different number of speakers, different speaker placement, and different speaker type in comparison to the second speaker configuration, and wherein the controller is further configured to rotate the housing structure via the at least one element, wherein when rotated in a first position with the first speaker configuration facing in a first direction, the controller is configured to select the first speaker configuration to be a primary source of audio output, and when rotated in a second position with the second speaker configuration facing the first direction, the controller is configured to select the second speaker configuration to be the primary source of audio output.

12. The loudspeaker of claim 11, wherein the housing structure rotates relative to first and second end units.

13. The loudspeaker of claim 11, wherein the housing structure rotates with first and second end units.

14. The loudspeaker of claim 11, wherein the housing structure is rotatably mounted to the first and second ends.

15. The loudspeaker of claim 11, further comprising at least one bracket mounted to a first and second end of the housing structure.

16. The loudspeaker of claim 15, wherein the bracket is an elongated bar extending along a portion of the housing structure.

17. The loudspeaker of claim 15, wherein the bracket is mounted to at least one of outer surfaces of the first and second ends, support elements of the first and second ends, and notched channels of the first and second ends.

18. The loudspeaker of claim 11, further comprising a drive unit to rotate the housing structure.

19. The loudspeaker of claim 11, wherein the housing structure is configured to rotate along a central axis of the loudspeaker to position one of the first speaker configuration and the second speaker configuration in a forward facing direction.

* * * * *